US012054953B2

(12) United States Patent
Neil et al.

(10) Patent No.: US 12,054,953 B2
(45) Date of Patent: Aug. 6, 2024

(54) GROOVED CORNERBEAD

(71) Applicant: Noll/Norwesco LLC, Fife, WA (US)

(72) Inventors: John Neil, Boca Raton, FL (US); Michael Starozhitsky, Long Grove, IL (US); David Starr, Vashon, WA (US)

( * ) Notice: Subject to any disclaimer, the term of this patent is extended or adjusted under 35 U.S.C. 154(b) by 0 days.

(21) Appl. No.: 17/874,885

(22) Filed: Jul. 27, 2022

(65) Prior Publication Data

US 2023/0046540 A1 Feb. 16, 2023

Related U.S. Application Data

(60) Provisional application No. 63/232,246, filed on Aug. 12, 2021.

(51) Int. Cl.
*E04F 13/06* (2006.01)

(52) U.S. Cl.
CPC ..... *E04F 13/068* (2013.01); *E04F 2013/063* (2013.01)

(58) Field of Classification Search
CPC ... E04F 13/06; E04F 2013/063; E04F 13/068; E04F 13/061
See application file for complete search history.

(56) References Cited

U.S. PATENT DOCUMENTS 1,167,837 A * 1/1916 Pride ..... E04B 5/40 52/250
1,608,475 A * 11/1926 Dean ..... E04F 13/06 52/255
4,313,991 A * 2/1982 Lamb ..... E04F 13/04 428/167
4,863,774 A * 9/1989 Tucker ..... E04F 13/06 52/417
4,876,837 A * 10/1989 Kelly ..... E04F 13/06 52/287.1
6,295,776 B1 10/2001 Kunz
6,539,680 B2 4/2003 Kunz
6,684,586 B1 * 2/2004 Hoffmann, Sr. ..... E04F 13/06 52/287.1
6,691,476 B1 2/2004 Kunz
6,722,092 B2 4/2004 Kunz
7,013,610 B2 3/2006 Kunz
7,383,668 B1 6/2008 Kunz
9,377,160 B1 * 6/2016 Smythe ..... E04F 13/06
11,193,668 B2 * 12/2021 Amundson ..... E04F 19/064
2002/0073638 A1 6/2002 Kunz
2006/0150570 A1 * 7/2006 Fitzpatrick ..... E04F 19/022 52/272
2006/0283115 A1 * 12/2006 Robertson ..... B29C 66/304 52/364

(Continued)

FOREIGN PATENT DOCUMENTS

CA 2197912 A1 * 9/1998
DE 29813133 U1 * 1/1999 ..... E04F 13/06

(Continued)

*Primary Examiner* — Theodore V Adamos
(74) *Attorney, Agent, or Firm* — Lippes Mathias LLP

(57) ABSTRACT

A cornerbead for drywall construction having an elongated strip with a longitudinal nose bent at a substantially right angle and having a left side and a right side extending outwardly from the longitudinal arcuate nose; at least one raised portion extending the length of the left side; and at least one raised portion extending the length of the right side.

17 Claims, 2 Drawing Sheets

(56) References Cited

U.S. PATENT DOCUMENTS

| | | | | |
|---|---|---|---|---|
| 2011/0030297 | A1* | 2/2011 | Robertson | B26F 1/384<br>52/287.1 |

FOREIGN PATENT DOCUMENTS

| | | | | |
|---|---|---|---|---|
| DE | 102014105391 | A1 * | 10/2015 | E04C 3/07 |
| EP | 0822301 | A1 * | 2/1998 | E04C 3/07 |
| GB | 2167797 | A * | 6/1986 | E04F 13/04 |

* cited by examiner

GROOVED CORNERBEAD

This application claims priority to provisional patent application 63/232,246 filed Aug. 12, 2021 and hereby incorporates that application by reference in its entirety.

FIELD OF INVENTION

This invention relates generally to drywall construction and, in particular, a gripping cornerbead.

BACKGROUND

Traditional cornerbead is structural strip which is fastened to corners where edges of drywall meet forming a surface transition between two different planar wall surfaces. Once installed the peak of the cornerbead trim provides a straight smooth guide for tradesman to float trowel over leveling drywall mud blending into continuous wall surface with a strong corner backing structure resisting dings, and chipping. The method of attaching the trim to the corner has evolved over time from nails and screws to staples and drywall mud.

Drywall is formed of sheets of plaster which are enclosed in an outer wrapping of heavy construction paper. When the drywall is attached to a wall, the joint between adjacent sheets of drywall is usually covered by a paper tape extending along the joint. The tape is then covered with wet plaster or mud. The plaster is smoothed along the edges of the tape to conceal the tape edges and form a smooth surface. The corners of the drywall often require cutting which can expose the plaster between the heavy paper sheets. The exposed plaster tends to chip or crumble unless these edges are protected.

BRIEF DESCRIPTION OF THE INVENTION

According to one aspect of the present invention, a cornerbead for drywall construction is provided having an elongated strip with a longitudinal nose (which may be a longitudinal arcuate nose) bent at a substantially right angle and having a left side and a right side extending outwardly from the longitudinal arcuate nose; at least one raised portion extending the length of the left side; and at least one raised portion extending the length of the right side.

DETAILED DESCRIPTION OF THE INVENTION

In the following detailed description, numerous specific details are set forth in order to provide a thorough understanding of the disclosure. However, it will be understood by those skilled in the art that the present disclosure may be practiced without these specific details. In other instances, well-known methods, procedures and components have not been described in detail so as not to obscure the present disclosure.

Figure 1:
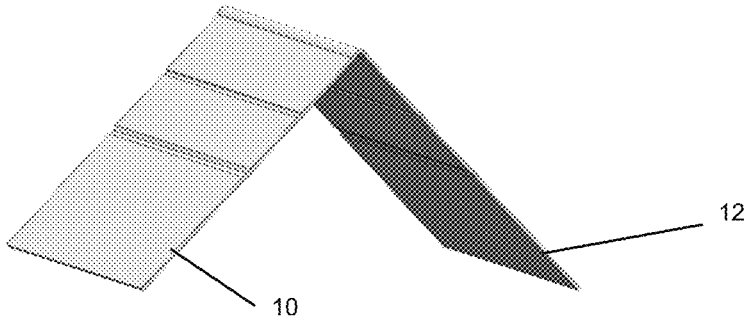
FIG. 1 depicts a cornerbead according to the present invention.
Figure 2:
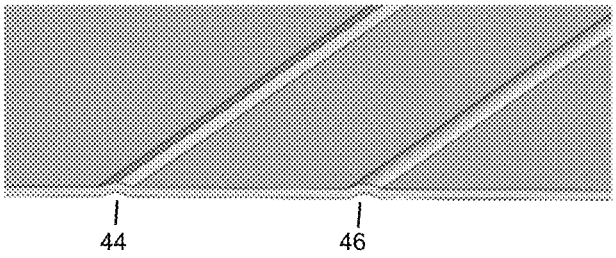
FIG. 2 depicts a cornerbead according to the present invention.
Figure 3:
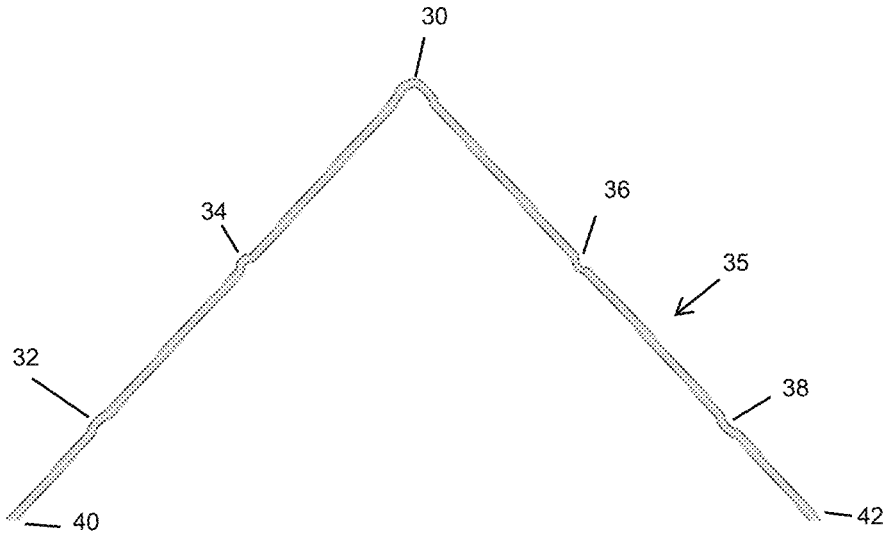
FIG. 3 depicts a cornerbead according to the present invention.
Figure 4:
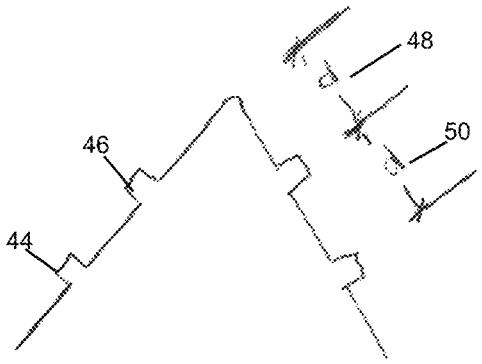
FIG. 4 depicts a cornerbead according to the present invention.
Figure 5:
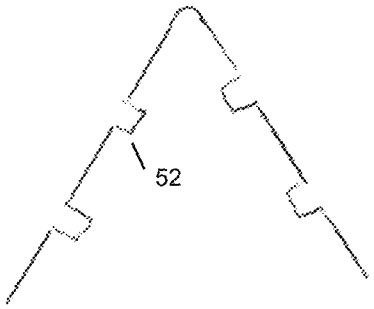
FIG. 5 depicts a cornerbead according to the present invention.
Figure 6:
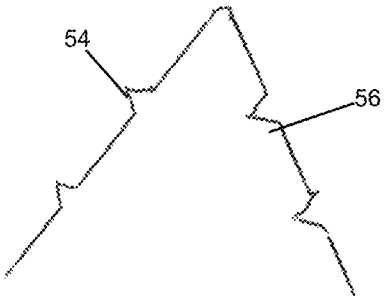
FIG. 6 depicts a cornerbead according to the present invention.
Figure 7:
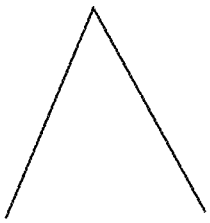
FIG. 7 depicts an arcuate nose according to one aspect of the present invention.

With reference to FIGS. 1, 2, 3, 4, 5 and 6 a cornerbead for drywall construction is provided, comprising: an elongated strip (35) having a longitudinal arcuate nose (30) bent at a substantially right angle and having a left side (40) and a right side (42) extending outwardly from the longitudinal arcuate nose (30); and at least one raised portion (e.g. 32, 34) extending the length of the left side; and at least one raised portion (e.g. 36, 38) extending the length of the right side. The longitudinal arcuate nose refers to the arc shape at the bend. FIG. 7 depicts a longitudinal nose not having the longitudinal arcuate nose for comparison (the peak does not have the arcuate nose). FIG. 1 depicts that the raised portion extends the length of the side (may be said to be parallel to the longitudinal arcuate nose). The elongated strip may be made of metal, plastic, vinyl or rigid composite material. The metal is galvanized steel or stainless steel. The at least one raised portion extending the length of the left side may be a convex rounded shape (34). The at least one raised portion extending the length of the left side is a concave rounded shape (36 depicts concave shape on right side). The at least one raised portion extending the length of the right side may be a convex rounded shape. The at least one raised portion extending the length of the right side may be a concave rounded shape. The at least one raised portion extending the length of the left side may be a convex triangular shape (54). The at least one raised portion extending the length of the left side may be a concave triangular shape (56). The at least one raised portion extending the length of the right side is a convex triangular shape (54). The at least one raised portion extending the length of the right side may be a concave triangular shape (56). The at least one raised portion extending the length of the left side is a convex rectangular shape (44, 46). The at least one raised portion extending the length of the left side is a concave rectangular shape (52). The at least one raised portion extending the length of the right side may be a convex rectangular shape (44. 46). The at least one raised portion extending the length of the right side may be a concave rectangular shape (52). The at least one raised portion extending the length of the left side and the right side may be two raised portions spaced equal distances from each other and the longitudinal arcuate nose bent at a substantially right angle. This may be seen in FIG. 4, the distance (48) between the first raised portion and the longitudinal arcuate nose is the same as the distance (50) between the first raised portion and the second raised portion.

The additional longitudinal features or 3D features onto the legs of cornerbead profile increase the flexural modulus. Features can be concave or convex and vary in height. There may be any combination of shapes and concave or convex raised portions. For example, the left side may have one convex rectangular raised portion and one concave triangular raised portion and the right side may be three concave rounded shaped portions. The 3D form also improves shear strength of adhesives applied by increasing the surface area as well as resistance to mechanical shear. The 3D features effectively increase the depth of section resulting in increased resistance to plastic deformation.

As part of product manufacturing process, additional features may be installed onto the back (or wall side) of cornerbead base material which mechanically adheres or attaches to the wall via deformed projections and/or adhesive. For configuration which includes raised or deformed features the trims could be installed with tapping mallet, or a V-shaped roller that pushes the features through the surface paper on drywall and hooks or locks trim onto corner. The spring tension resulting from the shape of the cornerbead trim can help hold tension against the perforated edge of the drywall paper surface. Adhesive type could be pre applied or site applied alternative to mud compound significantly reducing the installation time waiting for water-based drywall mud to cure. Adhesive compound could be chemical, hot melt, RTV, or UV cure single part or two-part systems. The adhesive would typically be a thin layer applied to the backside (10) of the elongated strip. The adhesive layer may be in communication with at least a portion of the right side, left side and longitudinal arcuate nose.

The described embodiments of the invention are intended to be exemplary and numerous variations and modifications will be apparent to those skilled in the art. All such variations and modifications are intended to be within the scope of the present invention as defined in the appended claims. Although the present invention has been described and illustrated in detail, it is to be clearly understood that the same is by way of illustration and example only, and is not to be taken by way of limitation. It is appreciated that various features of the invention which are, for clarity, described in the context of separate embodiments may also be provided in combination in a single embodiment. Conversely, various features of the invention which are, for brevity, described in the context of a single embodiment may also be provided separately or in any suitable combination. It is appreciated that the particular embodiment described in the specification is intended only to provide an extremely detailed disclosure of the present invention and is not intended to be limiting.

Modifications of the above disclosed apparatus and methods which fall within the scope of the invention will be readily apparent to those of ordinary skill in the art. Accordingly, while the present invention has been disclosed in connection with exemplary embodiments thereof, it should be understood that other embodiments may fall within the spirit and scope of the invention, as defined by the following claims.

What is claimed is:

1. A cornerbead for drywall construction, comprising:

an elongated strip having a longitudinal nose bent at a substantially right angle and having a left side and a right side extending outwardly from the longitudinal nose;

two raised portions spaced equal distances from each other and spaced apart by first and second planar surfaces of said left side and extending the length of the left side and each having a first portion protruding away from said first planar surface of the left side and a second portion extending into said second planar surface of the left side, wherein said first portion is formed by said second portion, wherein said first and second planar surfaces are on opposite sides of said left side; and at least one raised portion extending the length of the right side and having a right side first portion extending into a first planar surface of the right side and a right side second portion protruding away from a second planar surface of the right side, wherein said first and second planar surfaces of the right side are on opposite sides of the right side, wherein said second planar surface of said left side and said second planar surface of said right side face each other;

an adhesive layer in communication with at least a portion of the right side, the left side and the longitudinal nose;

wherein the first planar surface and the second planar surface of each side extends from the longitudinal nose toward an end of the respective side of the cornerbead.

2. A cornerbead for drywall construction as in claim 1, wherein the elongated strip is metal, plastic, vinyl or rigid composite material.

3. A cornerbead for drywall construction as in claim 2, wherein the metal is galvanized steel or stainless steel.

4. A cornerbead for drywall construction as in claim 1, wherein said two raised portions extending the length of the left side are a convex rounded shape.

5. A cornerbead for drywall construction as in claim 1, wherein said two raised portions extending the length of the left side are a concave rounded shape.

6. A cornerbead for drywall construction as in claim 1, wherein the at least one raised portion extending the length of the right side is a convex rounded shape.

7. A cornerbead for drywall construction as in claim 1, wherein the at least one raised portion extending the length of the right side is a concave rounded shape.

8. A cornerbead for drywall construction as in claim 1, wherein said two raised portions extending the length of the left side are a convex triangular shape.

9. A cornerbead for drywall construction as in claim 1, wherein said two raised portions extending the length of the left side are a concave triangular shape.

10. A cornerbead for drywall construction as in claim 1, wherein the at least one raised portion extending the length of the right side is a convex triangular shape.

11. A cornerbead for drywall construction as in claim 1, wherein the at least one raised portion extending the length of the right side is a concave triangular shape.

12. A cornerbead for drywall construction as in claim 1, wherein said two raised portions extending the length of the left side are a convex rectangular shape.

13. A cornerbead for drywall construction as in claim 1, wherein said two raised portions extending the length of the left side are a concave rectangular shape.

14. A cornerbead for drywall construction as in claim 1, wherein the at least one raised portion extending the length of the right side is a convex rectangular shape.

15. A cornerbead for drywall construction as in claim 1, wherein the at least one raised portion extending the length of the right side is a concave rectangular shape .

16. A cornerbead for drywall construction as in claim 1, wherein the at least one raised portion extending the length of the right side is two raised portions spaced equal distances from each other and the longitudinal nose bent at a substantially right angle.

17. A cornerbead for drywall construction as in claim 1, wherein the longitudinal nose is a longitudinal arcuate nose.

* * * * *